United States Patent [19]

Kobayashi et al.

[11] Patent Number: 4,484,552

[45] Date of Patent: Nov. 27, 1984

[54] ENGINE IDLING ROTATIONAL SPEED CONTROL DEVICE

[75] Inventors: Nobuyuki Kobayashi; Hiroshi Ito; Nobuhisa Ohkawa, all of Aichi, Japan

[73] Assignee: Toyota Jidosha Kabushiki Kaisha, Toyota, Japan

[21] Appl. No.: 407,170

[22] Filed: Aug. 11, 1982

[30] Foreign Application Priority Data

Aug. 13, 1981 [JP] Japan ..... 56-126887

[51] Int. Cl.[3] ..... F02M 3/00

[52] U.S. Cl. ..... 123/339; 123/587; 123/588

[58] Field of Search ..... 123/339, 480, 585, 586, 123/587, 588

[56] References Cited

U.S. PATENT DOCUMENTS

| | | | |
|---|---|---|---|
| 4,146,000 | 3/1979 | Hattori et al. | 123/587 |
| 4,240,145 | 12/1980 | Yano et al. | 123/587 |
| 4,289,100 | 9/1981 | Kinugawa et al. | 123/585 |
| 4,344,398 | 8/1982 | Ikeura | 123/339 |
| 4,344,399 | 8/1982 | Matsummara et al. | 123/339 |
| 4,365,599 | 12/1982 | Ikeura | 123/339 |
| 4,365,601 | 12/1982 | Yamazoe et al. | 123/339 |
| 4,375,208 | 3/1983 | Furuhashi et al. | 123/585 |
| 4,378,767 | 4/1983 | Kobashi et al. | 123/339 |
| 4,389,996 | 6/1983 | Yaegashi et al. | 123/339 |
| 4,392,468 | 7/1983 | Kobashi et al. | 123/585 |
| 4,401,073 | 8/1983 | Furuhashi | 123/339 |

FOREIGN PATENT DOCUMENTS 160138 12/1980 Japan ..... 123/339

*Primary Examiner*—Parshotam S. Lall

*Attorney, Agent, or Firm*—Cushman, Darby & Cushman

[57] ABSTRACT

Intake air flow rate control means having a control valve and a stepping motor for driving the control valve is arranged in a passage other than a passage in which a throttle valve is disposed. In a fast idling control mode (when a coolant temperature is below 70° C., for example) and a hot idling control mode (when the coolant temperature is above 70° C., for example), the control valve is driven by the stepping motor to control an engine idling rotational speed. The numbers of steps of the stepping motor for given coolant temperatures, which are to be used in the fast idling control mode, are previously stored as tables ST1~ST3. A converted value ISTA of steps corresponding to a target rotational speed is calculated based on a predetermined conversion expression. An arithmetic operation is carried out such that the number of steps ISTEP, which was learnt in the previous hot idling control mode and stored in a permanently powered memory, is equal to the converted value ISTA. In the fast idling control mode, prior to the feedback control of the control valve, the number of steps of the stepping motor ST for the given coolant temperature is corrected based on the number of steps ISTEP stored in the memory. The stepping motor is controlled by the corrected number of steps ST1A~ST3A.

8 Claims, 7 Drawing Figures

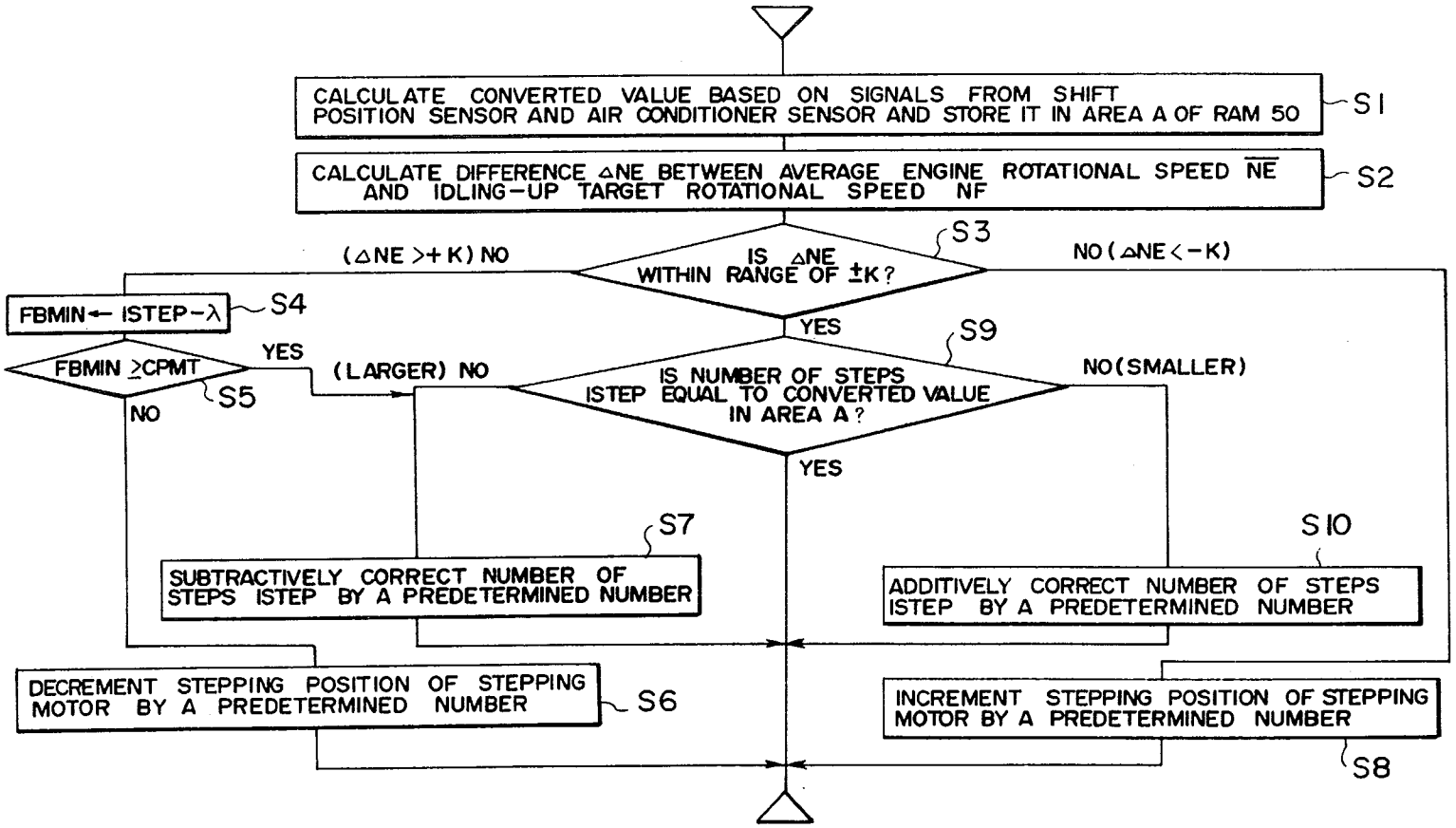
FIG. 6
S1
CALCULATE CONVERTED VALUE BASED ON SIGNALS FROM SHIFT POSITION SENSOR AND AIR CONDITIONER SENSOR AND STORE IT IN AREA A OF RAM 50
S2
CALCULATE DIFFERENCE ΔNE BETWEEN AVERAGE ENGINE ROTATIONAL SPEED $\overline{NE}$ AND IDLING-UP TARGET ROTATIONAL SPEED NF
S3
IS ΔNE WITHIN RANGE OF ±K?
(ΔNE >+K) NO
NO (ΔNE <-K)
YES
S4
FBMIN ← ISTEP-λ
S5
FBMIN ≥CPMT
YES
NO
S9
IS NUMBER OF STEPS ISTEP EQUAL TO CONVERTED VALUE IN AREA A?
(LARGER) NO
NO (SMALLER)
YES
S10
ADDITIVELY CORRECT NUMBER OF STEPS ISTEP BY A PREDETERMINED NUMBER
S7
SUBTRACTIVELY CORRECT NUMBER OF STEPS ISTEP BY A PREDETERMINED NUMBER
S8
INCREMENT STEPPING POSITION OF STEPPING MOTOR BY A PREDETERMINED NUMBER
S6
DECREMENT STEPPING POSITION OF STEPPING MOTOR BY A PREDETERMINED NUMBER

ENGINE IDLING ROTATIONAL SPEED CONTROL DEVICE

BACKGROUND OF THE INVENTION

1. Field of the Invention

The present invention relates to an engine idling rotational speed control device, and more particularly to an engine rotational speed control device for controlling an idling rotational speed of an engine.

2. Description of the Prior Art

In an engine such as an automobile engine, an engine rotational speed control device is usually used in order to maintain smooth rotation of the engine even when a throttle valve is in a full-close position by removal of a foot of a driver from an accelerator pedal in a non-load condition. One type of the engine rotational speed control device comprises intake air flow rate control means for controlling an intake air quantity in the idling position of the engine or the full-close position of the throttle valve, a stepping motor for driving the intake air flow rate control means and an electronic control circuit for controlling the stepping motor in accordance with the operating condition of the engine.

When such a device is used in an engine having an electronically controlled fuel injection device including a throttle body in which the throttle valve for controlling the intake air quantity is arranged and a fuel injection device for injecting fuel to air suctioned into an intake manifold through the throttle body, a bypass passage for bypassing the throttle valve of the throttle body is provided to control the opening area of the bypass passage by an intake air flow rate control valve driven by the stepping motor in the idling condition or the full-close position of the throttle valve in order to control the intake air quantity in the idling condition. With the idling rotational speed control device provided with the air flow rate valve driven by the step motor as described above, in the electronic control circuit, the increase or decrease in pulse number for driving the step motor from the reference position is calculated, whereby the opening degree of the air flow rate control valve is brought into register with the position of the step motor stored in the electronic control circuit, so that the opening degree of the air flow rate control valve can be detected.

As shown in FIG. 1, in the prior art device, when an ignition switch is turned off from its on position at a time $t_1$, the stepping motor is driven to fully open the control valve at a time $t_2$ in order to prevent freeze in a low temperature environment. As the engine is in a full operation at a time $t_3$, the flow rate control valve is abruptly closed by the stepping motor (see a time period between $t_3$ and $t_4$) to attain an idling rotational speed set in accordance with an engine coolant temperature. After a time $t_4$, the step position of the stepping motor is corrected such that a target idling rotational speed for the engine coolant temperature is attained and the step position of the stepping motor is controlled to maintain the target idling rotational speed.

In the idling condition or fast idling condition in which the engine coolant temperature is below a predetermined temperature such as in a start condition or a warm-up condition, in order to control the stepping position of the stepping motor, a table for the stepping position of the stepping motor versus the engine coolant temperatures is stored and an appropriate stepping position of the stepping motor is selected by looking up the table based on an engine coolant temperature signal and an air conditioner ON signal. Thus, as the engine and the sensors are aged, the engine rotational speed in the fast idling condition changes so that the initially intended fast idling rotational speed is not maintained. In other words, the fast idling rotational speed changes by aging.

SUMMARY OF THE INVENTION

It is an object of the present invention to provide an engine idling rotational speed control device which suppresses the change in the fast idling rotational speed by aging and increases a reliability of the engine.

In accordance with one feature of the present invention, the idling rotational speed in the fast idling condition is controlled by using a data previously learnt and stored in a hot idling control operation.

In one preferred embodiment of the present invention, intake air flow rate control means includes a stepping motor and a flow rate control valve driven by the stepping motor, and the number of steps of the stepping motor ST1~ST3 for a given engine coolant temperature, which is to be used in the fast idling condition, is previously stored. In a hot idling condition, a converted valve ISTA corresponding to a target rotational speed is calculated from one of four conversion expressions which are previously selected for N-range and D-range of an automatic transmission car and ON and OFF states of an air conditioner. An operation is carried out such that the number of steps ISTEP which was learnt in the hot idling condition and stored in a continuously powered memory is equal to the converted value ISTA. In the fast idling condition, prior to the feedback control of the control valve, the number of steps of the stepping motor for the given engine coolant temperature is corrected by referring to the number of steps ISTEP stored in the memory. The corrected number of step ST1A~ST3A of the stepping motor is used to control the stepping motor.

BRIEF DESCRIPTION OF THE DRAWINGS

FIG. 6 shows a flow chart of an operation in a feedback control in the hot idling control in the embodiment of the present invention.

DETAILED DESCRIPTION OF THE PREFERRED EMBODIMENT

Figure 1:
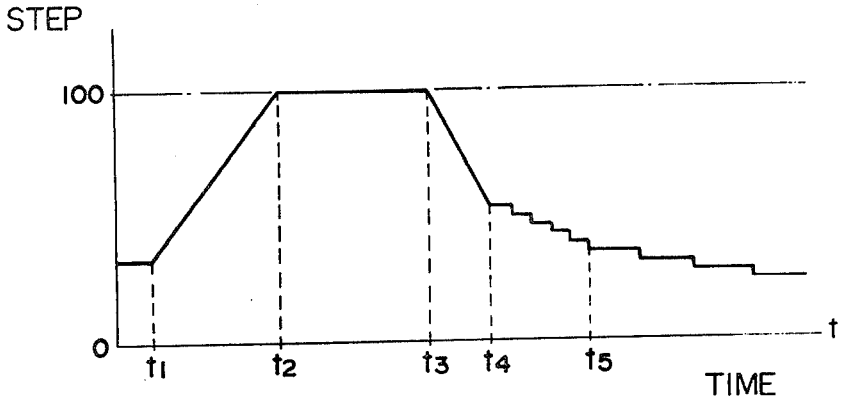
FIG.1 PRIOR ART
FIG. 1 shows a chart of a stepping position of a stepping motor versus time.
Figure 2:
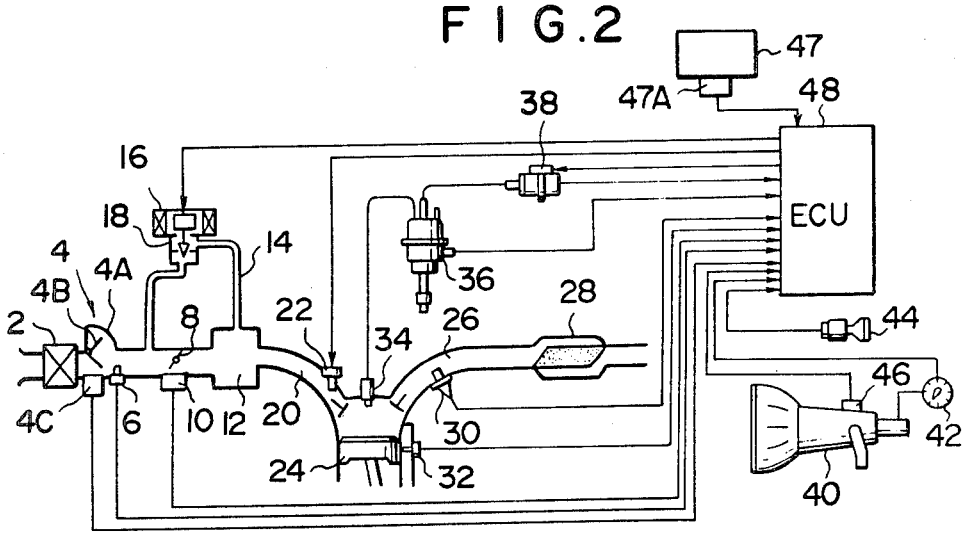
FIG. 2 shows a block diagram of one embodiment of the present invention.

FIG. 2 shows a block diagram of one embodiment of the engine rotational speed control device of the present invention. Detailed description will hereunder be given of such device that is applied to an automatic transmission car. The present embodiment has an air cleaner 2 and an air flow meter 4, which functions as an intake air quantity sensor, arranged downstream of the air cleaner 2. The air flow meter 4 comprises a compensation plate 4B pivotably mounted in a damping chamber 4A and a potentiometer 4C for sensing an opening angle of the compensation plate 4B. The intake air quanitity is thus sensed as a voltage from the potentiometer 4C. An intake air temperature sensor 6 for sensing a temperature of the intake air is arranged in the vicinity of the air flow meter 4.

A throttle valve 8 is arranged downstream of the air flow meter 4, and a throttle sensor 10 such as a throttle switch for sensing an opening area of the throttle valve 8 to produce a throttle position signal is arranged in the vicinity of the throttle valve 8. Provided downstream of the throttle valve 8 is surge tank 12 to which a bypass passage 14 for bypassing the throttle valve 8 is connected. An intake air flow rate control valve 18 which is controlled by a stepping motor 16 is arranged in the bypass passage 14. In general, in an idling condition of the engine, the intake air bypasses the throttle valve 8 and flows into the surge tank 12 through the intake air flow rate control valve 18. As will be described later, the opening area of the control valve 18 is feedback-controlled in order to maintain a desired engine idling rotational speed which is related to an operating condition of a motor vehicle.

An intake manifold 20 is connected to the surge tank 12 and a fuel injection device 22 is arranged to extend into the intake manifold 20. The intake manifold 20 is connected to a combustion chamber of an engine 24, which is connected to a catalyst converter 28 filled with a three-way catalyst, through an exhaust manifold 26. Numeral 30 denotes an $O_2$ sensor for controlling an air-to-fuel ratio of a gas mixture to a vicinity of a stoichiometric air-to-fuel ratio, and numeral 32 denotes a coolant temperature sensor for sensing a temperature of an engine coolant.

Ignition plugs 34 of the engine 24 are connected to a distributor 36 which is connected to an igniter 38. Numeral 40 denotes a transmission, numeral 42 denotes a vehicle speed sensor and numeral 44 denotes an ignition switch. The transmission gear 40 is provided with a shift position sensor 46 having a neutral start switch for sensing a neutral position and a drive position of a shift lever.

The distributor 36 is provided with a gear-shaped signal rotor or a timing rotor fixed to a distributor shaft and a pickup mounted on a housing of the distributor 36 to oppose to teeth of the signal rotor. As the signal rotor rotates, the amount of magnetic flux which link to the pickup changes so that an engine rotational speed signal is produced. The signal rotor and the pickup form an engine rotational speed sensor.

An air-conditioner 47 for regulating an inside temperature and an inside humidity of the motor vehicle and for purifing an inside air thereof is arranged under an instrument panel in the motor vehicle. The air-conditioner 47 is provided with an air-conditioner sensor 47A which outputs an air-conditioner ON signal when the air-conditioner 47 is energized.

Figure 3:
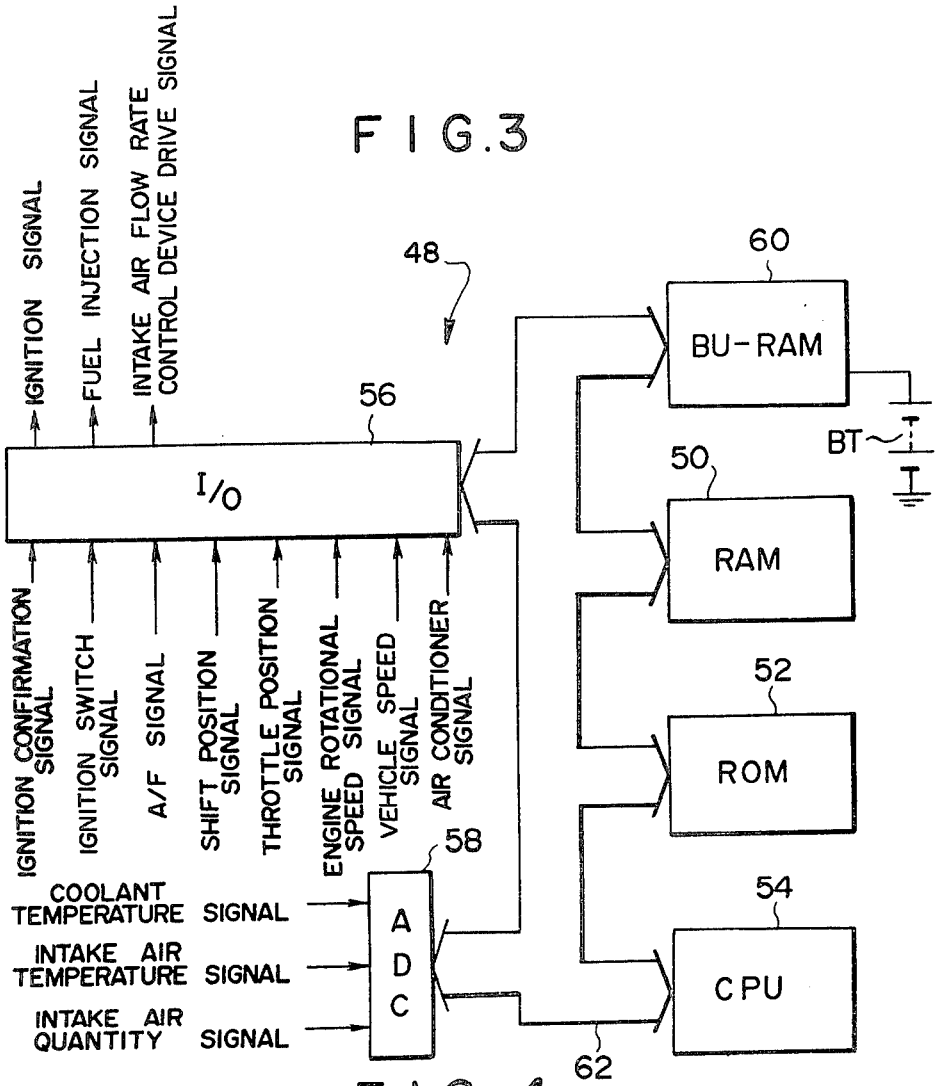
FIG. 3 shows a block diagram of an electronic control circuit of the embodiment of FIG. 2.

Referring to FIG. 3, an electronic control circuit 48 which receives signals from the vehicle speed sensor 42, the shift position sensor 46 and other sensors comprises a random access memory (RAM) 50, a read-only memory (ROM) 52, a central processing unit (CPU) 54, an input/output circuit (I/O) 56, an analog-to-digital converter (ADC) 58 and a backup random access memory (BU-RAM) 60. The BU-RAM 60 is powered from a separate battery BT and a memory content thereof is not erased by other than write instruction. The RAM 50, ROM 52, CPU 54, I/O 56, ADC 58 and BU-RAM 60 are interconnected through a bus 62 including a data bus.

The following conversion expressions used in a hot idling control (which is effected when an engine coolant temperature is higher than 70° C.) are stored in a ROM 52. A converted value ISTA calculated in accordance with one of the conversion expressions is compared with the number of steps ISTEP which has been stored in a BU-RAM 60 when the hot idling control was effected.

Respective conversion expressions for calculating the converted value ISTA are given as follows in accordance with positions of a shift lever which are detected by the shift position sensor 46 and operational conditions of the air-conditioner 47 which are detected by the air-conditioner sensor 47A.

(i) When the shift lever is in a neutral position (N range) and the air-conditioner 47 is OFF.

$$ISTA = CPMT - (NF - \beta_1)/\alpha_1 \quad (1)$$

(ii) When the shift lever is in a drive position (D range) and the air-conditioner 47 is OFF.

$$ISTA = CPMT - \gamma_1 - (NF - \beta_2)/\alpha_2 \quad (2)$$

(iii) When the shift lever is in the neutral position (N range) and the air-conditioner 47 is ON.

$$ISTA = CPMT - \gamma_2 - (NF - \beta_3)/\alpha_3 \quad (3)$$

(iv) When the shift lever is in the drive position (D range) and the air-conditioner 47 is ON.

$$ISTA = CPMT - \gamma_3 - (NF - \beta_4)/\alpha_4 \quad (4)$$

Where, $\alpha_1 \sim \alpha_4$, $\beta_1 \sim \beta_4$ and $\gamma_1 \sim \gamma_3$ are constants, CPMT is a stepping position of the stepping motor stored in the BU-RAM 60, and NF is a target engine idling-up rotational speed for a given engine coolant temperature and is stored in ROM 52 as a table for each of the conditions (i)~(iv). The converted valve ISTA calculated in accordance with one of the conversion expressions (1)~(4) is stored in an area A of the RAM 50. The previous number of steps ISTEP and the stepping position CPMT corresponding to the stepping position of the stepping motor 16 has been stored in the BU-RAM 60.

The number of steps ISTEP can be stored in the BU-RAM 60 as 12-bit data, 6-bits of which are used as an integer value field for number of steps ISTEP and 5-bits of which are used as a correction value field which is stepped at every 32 cycles. The BU-RAM 60 also stores a learnt table in the fast idling control, as will be described later.

Figure 4:
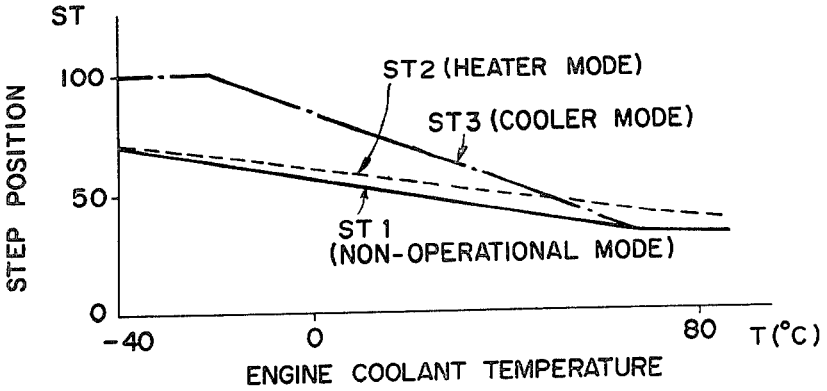
FIG. 4 shows a table of the number of steps of the stepping motor versus engine coolant temperature used in the fast idling control.

The ROM 52 in the electronic control circuit 48 stores a table shown in FIG. 4 which relates to the stepping position ST of the stepping motor 16 for the given engine coolant temperature. This table is used in the fast idling control. In the present embodiment, the term fast idling control means an engine rotational speed control which is carried out when the engine coolant temperature is lower than 70° C. In FIG. 4, a table ST1 is used when both a hot maximum switch and a cool maximum switch are ON in the air conditioner OFF state or the air conditioner ON state, a table ST2 is used when the hot maximum switch is ON in the air conditioner ON state, and a table ST3 is used when the hot maximum switch is OFF and the cool maximum switch is ON in the air conditioner ON state. One of those tables is selected in accordance with the signal states of the respective sensors and stored in a predetermined area of the RAM 50 for subsequent use in controlling the stepping motor 16. The hot maximum switch and the cool maximum switch are mounted on the air condition and they are turned on or off depending on the vehicle room temperature and a preset temperature when the air conditioner is ON.

Applied to the I/O 56 are the engine rotational speed signal from the distributor 36, the throttle position signal from the throttle sensor 10, the shift position signal from the shift position sensor 46, the ignition switch signal from the ignition switch 44, the ignition confirmation signal from the igniter 38, the vehicle speed signal, the air conditioner signal and the air-to-fuel ratio signal from the $O_2$ sensor 30, and the I/O 56 produces an intake air flow rate control device drive signal for controlling the intake air flow rate control device 18, a fuel injection signal for controlling the fuel injection device 22 and an ignition signal for controlling the igniter 38 and the like. The ADC 58 receives the intake air quantity signal from the air flow meter 4, the intake air temperature signal from the intake air temperature sensor 6 and the coolant temperature signal from the coolant temperature sensor 32. Those signals are converted to digital signals by the ADC 58.

The ROM 52 stores therein maps and tables for various operating conditions of the engine, in addition to the tables described above, and the I/O 56 and ADC 58 receive and supply various signals for the operating conditions of the engine, in addition to the signals described above.

Figure 5:
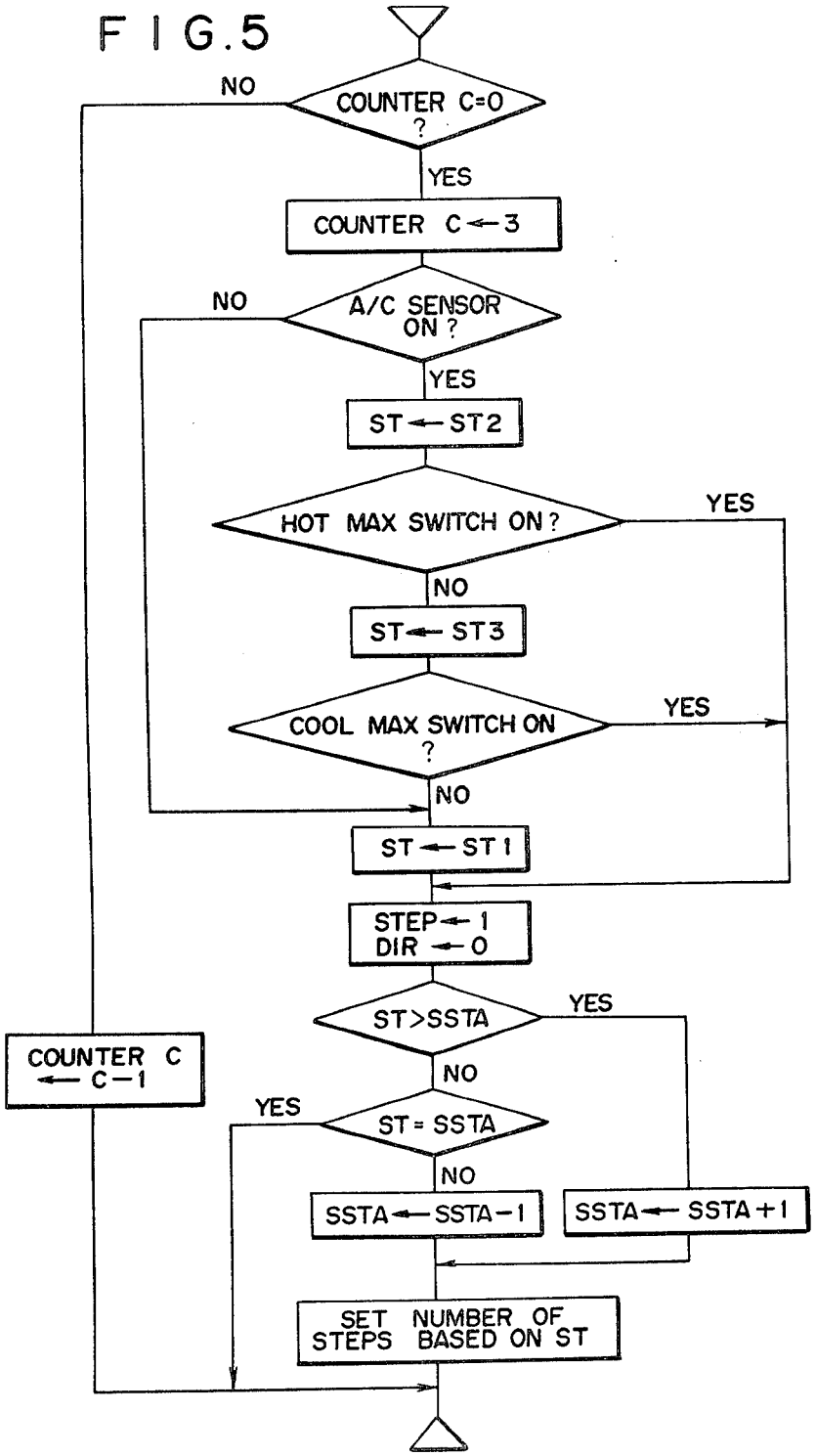
FIG. 5 shows a flow chart for an operation in the fast idling control.

FIG. 5 shows a general procedure for the fast idling control. It is executed at every three seconds, for example. A content of the counter C is checked to determine if it is zero or not, and if it is zero, three (seconds) is set to the counter C. Then, the air conditioner sensor 47A is checked to determine if it is ON or not. If the signal from the air conditioner sensor 47A is OFF, the table ST1 shown in FIG. 4 is set in the area ST of the RAM 50. If the signal from the air conditioner sensor 47A is ON, the table ST2 shown in FIG. 4 is set in the area ST of the RAM 50. If the hot maximum switch in ON, the table ST2 is kept unchanged, and if hot maximum switch is OFF, the table ST3 is set in the area ST, and if the cool maximum switch is ON, the table ST3 is kept unchanged. If the cool maximum switch is OFF, the table ST1 is set in the area ST. The content of the area ST of the RAM 50 is then compared with a start stepping position SSTA which indicates an actual stepping position of the stepping motor 16, and if ST>SSTA, the content of SSTA is incremented by one, and if ST<SSTA, the content of SSTA is decremented by one. If ST=SSTA, no change is made. The drive of the stepping motor 16 is controlled by the table stored in the area ST. The counter C is decremented at every one second and the control is effected at every three seconds. It should be understood that the control may be effected at any desired cycle time by changing the content of the counter C. In this case, however, an influence by the aging of the engine appears because the content of the area ST of the RAM 50 is fixed. Thus, the tables ST1 to ST3 are controlled by the number of steps ISTEP which has been learnt in the feedback control in the hot idling control operation to be described later, in accordance with a flow chart shown in FIG. 7 so that the influence by the aging is prevented.

An operation of the present embodiment will be described hereunder with reference to FIG. 4. First of all, a feedback control of the intake air flow rate control valve 18 is briefly explained.

The opening area of the intake air flow rate control valve 18 is feedback-controlled so that the engine rotational speed is brought into a desirable engine rotational speed for a given engine coolant temperature in the hot idling control, which is effected when the engine coolant temperature is higher than 70° C. The stepping position of the stepping motor 16 is controlled to adjust the opening area of the intake air flow rate control valve 18. The control valve 18 is feedback-controlled under the following conditions. In N range, when the engine coolant temperature is higher than 70° C. and the throttle sensor 10 is ON, i.e., the throttle valve is substantially fully closed, and in D range, when the engine coolant temperature is higher than 70° C., a vehicle speed is less than 2 Km/h and the throttle sensor is ON, the feedback control is effected. The feedback control is stopped when the value of the motor stepping position CPMT stored in BU-RAM 60 reaches a predetermined value.

In the feedback control, the engine rotational speed is measured for a predetermined time period, e.g., 2 sec, after a predetermined time period, e.g. 2 sec, has elapsed since a condition of the above-described feedback control was fulfilled, and an average engine rotational speed is calculated. If the average engine rotational speed is beyond an upper and lower limit of the target engine rotational speed, the stepping motor 16 is driven by one step. If the condition of the feedback control is lost in the course of the feedback control, the feedback control is stopped.

Referring to FIG. 6, in Step S1, a signal from the shift position sensor 46 and an ON signal from the air-conditioner sensor 47A indicating the activation of the air-conditioner 47 are taken into the CPU 54, one of the above-described conversion expressions (1)~(4) stored in the ROM 52 is selected based on those signals and the target idling up engine rotational speed NF is determined based on the engine coolant temperature. In addition, the target idling-up engine rotational speed NF is placed into the selected conversion expression to calculate the converted value ISTA which is then stored in the area A of the RAM 50.

In a Step S2, a difference ΔNE between the average engine rotational speed $\overline{NE}$ (which may be an average engine rotational speed in two seconds) and the target engine idling-up rotational speed NF is calculated. In a Step S3, it is checked if the difference ΔNE is within a predetermined range ±K (e.g., K=20 rpm), and if ΔNE>+K, the process goes to a step S4 in which a given constant λ (e.g., λ=3) is subtracted from the number of steps ISTEP stored in the BU-RAM 60, and the resulting difference is used as a feedback lower limit FBMIN which is then stored in an area FF of the RAM 50. Then the process is shifted to a Step S5.

In the Step S5, the stored feedback lower limit FBMIN is compared with the current stepping position CPMT of the stepping motor 16. If the feedback lower limit FBMIN is smaller than the motor stepping position CPMT, the process goes to a Step S6 in which the stepping position of the stepping motor 16 is decremented by one step so that the opening area of the flow rate control valve 18 is reduced. On the contrary, if the feedback lower limit is larger than the current stepping position CPMT stored in the BU-RAM 60, the process goes to a step S7 in which the stepping position of the stepping motor 16 is not changed but the number of steps ISTEP is downwardly corrected by 1/32 step and the corrected number of steps is stored in the BU-RAM 60 as a new number of steps ISTEP. In this manner, the number of steps ISTEP in the BU-RAM 60 is updated in a learnt mode.

In the Step S3, if the decision is $\Delta NE < -K$, the process goes to the Step S8 in which the stepping position of the stepping motor 16 is incremented by one step to increase the opening area of the flow rate control valve 18.

In addition, if $\Delta NE$ is within the predetermined range $\pm K$, the number of steps ISTEP is corrected so that the number of steps ISTEP is rendered to be equal to the converted valve ISTA. More specifically, in a Step S9, the converted value ISTA is compared with the number of steps ISTEP. If the ISTEP is larger than the ISTA, the process is shifted to a Step S7 where a predetermined value (e.g. 1/32 step) is subtracted from the number of steps ISTEP and resulting difference is stored in the BU-RAM 60 as a new number of steps ISTEP. In the Step S9, if the ISTEP is smaller than the ISTA, the process is shifted to a Step S10 in which a predetermined value (e.g. 1/32 step) is added to the number of steps ISTEP to correct the number of steps ISTEP. The resulting sum is stored in the BU-RAM 60 as a new number of steps ISTEP. If the number of steps ISTEP is equal to the converted value ISTA, the correction is not effected.

In accordance with a feature of the present invention, the number of steps ISTEP has been previously learnt and stored in the BU-RAM 60. Thus, the stepping position ST1~ST3 of the stepping motor 16 for the engine coolant temperature in the fast idling condition is learnt based on the learnt number of steps ISTEP in the previous hot idling condition and the stepping motor 16 is controlled by the newly learnt stepping position ST1A~ST3A thereof.

Figure 7:
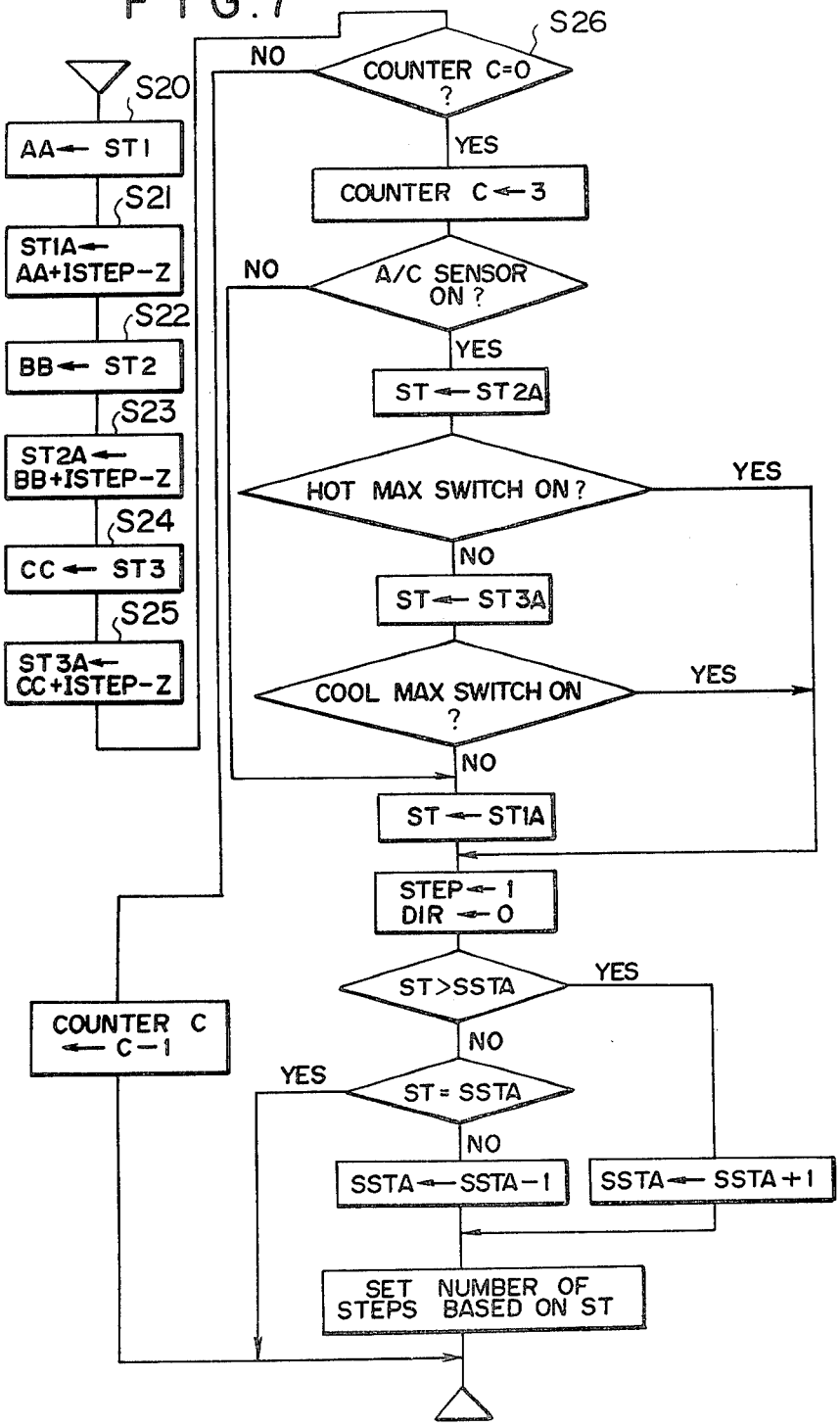
FIG. 7 shows a flow chart for an operation in the fast idling condition in the embodiment of the present invention.

The flow chart shown in FIG. 7 is now explained. The flow chart of FIG. 7 differs from the flow chart of FIG. 5 in that the former does not directly use the table of FIG. 4. The content of the table of FIG. 4 is first stored in the RAM 50, and the content of the table stored in the RAM 50 is modified by learning the number of steps ISTEP previously stored in the BU-RAM 60, and the updated content is stored in a predetermined area of the BU-RAM 60. The stepping motor 16 is driven based on the learnt result stored in the predetermined area of the BU-RAM 60.

More specifically, prior to a step S27 in which the content of the counter C is checked to determine if it is zero or not, the following steps are carried out. In a step S20, the table ST1 shown in FIG. 4 is read out from the ROM 52 and it is written in an area AA of the RAM 50. In a step S21, a calculation (AA+ISTEP−Z) is carried out using the number (AA) read from the area AA, and the result is stored in the BU-RAM 60 as a table ST1A. Similarly, in the step S22, the table ST2 is read out from the ROM 52 and it is stored in an area BB of the RAM 50. In a step S23, a calculation (BB+ISTEP−Z) is carried out using the number (BB) read from the area BB and the result is written in the BU-RAM 60 as a table ST2A. In a step S24, the table ST3 is read from the ROM 50 and it is stored in an area CC of the RAM 50. In a step S25, a calculation (CC+ISTEP−Z) is carried out using the number (CC) read from the area CC and the result is writen in the BU-RAM 60 as a table ST3A. Where, Z is a constant which may be 30, for example. One of the tables ST1A, ST2A and ST3A stored in the BU-RAM 60 is selected depending on the ON or OFF state of the air conditioner and the ON or OFF state of the hot maximum switch or the cool maximum switch, for the subsequent control. The flow after the setting of the table ST is identical to the corresponding part of the flow chart of FIG. 5 and hence it is not explained here.

In summary, according to the feature of the present embodiment, the stepping position of the stepping motor 16 is feedback-controlled such that when the conditions of the hot idling feedback control is met by the shift position signal from the shift position sensor 46, the coolant temperature signal from the coolant temperature sensor 32, the vehicle speed signal from the vehicle speed sensor 42 and the throttle signal from the throttle sensor 10, the rotational speed of the engine 24 is kept within the predetermined target rotational speed range, and the stepping position of the stepping motor 16 in the fast idling condition is controlled by the number of steps ISTEP which was learnt in the feedback control in the hot idling condition.

As described hereinabove, according to the present invention, the stepping position of the stepping motor in the fast idling condition is controlled by the number of steps ISTEP which was learnt in the feedback control in the hot idling condition. Therefore, the aging effect of the fast idling rotational speed is prevented and the reliability of the engine is enhanced.

What is claimed is:

1. An engine idling rotational speed control device for use in an engine having an associated accelerator pedal and air-conditioner and including a main intake passage, a bypass intake passage and a combustion chamber, said device comprising:

a throttle valve provided in said main intake passage and substantially fully closed when said accelerator pedal is released;

a flow rate control valve provided in said bypass intake passage for controlling the quantity of intake air taken into said combustion chamber through said bypass intake passage;

a valve driving means for driving said flow rate control valve; and an electronic control circuit for:

controlling said flow rate control valve through said valve driving means for maintaining said engine rotational speed within a target rotational speed range by increasing or decreasing said intake air quantity taken into said bypass intake passage;

learning a first value which coincides with a converted value obtained by cancelling an incremental value for an idle up required in accordance with a load on the engine and/or a coolant temperature from a value corresponding to a current opening area of said flow rate control valve;

determining a second value during a fast idling control operation, corresponding to a predetermined opening area of said flow rate control valve, in accordance with the coolant temperature from one of a plurality of curves selected in accordance with operational conditions of said air-conditioner, said curves showing a relationship between the second value and the coolant temperature;

correcting said second value during the fast idling control operation on the basis of said first value to determine a corrected second value; and controlling said valve driving means by using said corrected second value during the fast idling control operation such that the engine rotational speed becomes a predetermined rotational speed corresponding to said corrected second value.

2. An engine idling rotational speed control device according to claim 1, wherein when the engine rotational speed is within a predetermined target rotational speed range, said first value is learned.

3. An engine idling rotational speed control device according to claim 1, wherein said converted value is obtained from one of a plurality of conversion expressions predetermined for a first condition in which the shift position of an automatic transmission car is in a drive range and the air-conditioner is in the ON state, a second condition in which the shift position is in the drive range and the air-conditioner is in the OFF state, a third condition in which the shift position is in a neutral range and the air-conditioner is in the ON state and a fourth condition in which the shift position is in the neutral range and the air-conditioner is in the OFF state.

4. An engine idling rotational speed control device according to claim 1, wherein said plurality of curves are predetermined with respect to a cooler mode in which a cool max switch is in the ON state and the engine rotational speed predetermined in accordance with the coolant temperature is the highest in all modes, a heater mode in which a hot max switch is in the ON state and the engine rotational speed predetermined in accordance with the coolant temperature is lower than that of the cooler mode, a non-operational mode in which the air-conditioner is in the OFF state and the engine rotational speed predetermined in accordance with the coolant temperature is the lowest in all modes.

5. An engine idling rotational speed control device according to claim 1, wherein said valve driving means comprises a stepping motor, and said incremental value for idle up and said value corresponding to a current opening area of said flow rate control valve are defined as an idle step number of said stepping motor, respectively.

6. An engine idling rotational speed control device according to claim 5, wherein said incremental value includes a value predetermined in accordance with a shift position of an automatic transmission car and/or ON-OFF state of an air conditioner and a value calculated on the basis of a target rotational speed determined by the coolant temperature.

7. An engine idling rotational speed control device according to claim 5, wherein when the engine rotational speed is within a predetermined target rotational speed range, an idle step number is learned.

8. An engine idling rotational speed control device according to claim 7, wherein said idle step number is learned by a value less than 1.0 at every learning timing.

* * * * *